US007146991B2

(12) United States Patent
Stockert

(10) Patent No.: US 7,146,991 B2
(45) Date of Patent: Dec. 12, 2006

(54) PARTS WASHER SYSTEM

(75) Inventor: David L Stockert, New Boston, MI (US)

(73) Assignee: Cinetic Automation Corporation, Farmington Hills, MI (US)

( * ) Notice: Subject to any disclaimer, the term of this patent is extended or adjusted under 35 U.S.C. 154(b) by 242 days.

(21) Appl. No.: 10/342,977

(22) Filed: Jan. 15, 2003

(65) Prior Publication Data

US 2003/0136424 A1 Jul. 24, 2003

Related U.S. Application Data

(60) Provisional application No. 60/351,296, filed on Jan. 23, 2002.

(51) Int. Cl.
*B08B 3/02* (2006.01)

(52) U.S. Cl. ..... 134/57 R; 134/111; 134/131; 134/184

(58) Field of Classification Search ..... 134/56 R, 134/57 R, 111, 124, 129, 131, 184
See application file for complete search history.

(56) References Cited

U.S. PATENT DOCUMENTS

| | | | | |
|---|---|---|---|---|
| 2,202,344 | A | | 5/1940 | Hamilton et al. |
| 2,405,838 | A | | 8/1946 | Lawson et al. |
| 2,837,685 | A | | 6/1958 | Umbricht |
| 2,857,922 | A | | 10/1958 | Effinger |
| 2,926,674 | A | | 3/1960 | Umbricht et al. |
| 3,030,896 | A | * | 4/1962 | Umbricht et al. ..... 104/162 |
| 3,030,971 | A | * | 4/1962 | Umbricht et al. ..... 134/102.1 |
| 3,059,861 | A | | 10/1962 | Umbricht et al. |
| 3,102,057 | A | * | 8/1963 | Umbricht et al. ..... 134/23 |
| 3,276,458 | A | | 10/1966 | Iversen et al. |
| 3,439,810 | A | | 4/1969 | Newman et al. |
| 3,443,567 | A | | 5/1969 | Moore |
| 3,605,775 | A | | 9/1971 | Zaander et al. |
| 3,614,231 | A | | 10/1971 | Shaw |
| 3,624,750 | A | | 11/1971 | Peterson |
| 3,664,355 | A | | 5/1972 | Adams |
| 3,870,417 | A | | 3/1975 | Bashark |
| 3,888,269 | A | | 6/1975 | Bashark |
| 4,054,148 | A | | 10/1977 | Gurr |
| 4,067,293 | A | | 1/1978 | Probst |
| 4,117,855 | A | | 10/1978 | Olcott et al. |
| 4,222,250 | A | | 9/1980 | Torita |
| 4,323,398 | A | | 4/1982 | Simon |

(Continued)

FOREIGN PATENT DOCUMENTS

| | | |
|---|---|---|
| CA | 656624 | 1/1963 |

(Continued)

OTHER PUBLICATIONS

Owner's Manual, "Model 215W Liquidborne Laser Particle Counter", (believed to have been published and/or offered for sale in 1995).

*Primary Examiner*—Joseph L. Perrin
(74) *Attorney, Agent, or Firm*—Harness, Dickey & Pierce, P.L.C.

(57) ABSTRACT

An industrial parts washer system includes washing fluid, an assembly operable to apply the washing fluid to the part, a turbidity sensor coupled to the assembly operable to sense a condition of the washing fluid after the fluid washes the part, and a control unit connected to the sensor that compares the sensed condition of the washing fluid to a value and thereby determines whether the part should be washed further.

33 Claims, 10 Drawing Sheets

U.S. PATENT DOCUMENTS

| | | | | |
|---|---|---|---|---|
| 4,325,161 | A | 4/1982 | Wood et al. | |
| 4,381,794 | A | 5/1983 | Stimac et al. | |
| 4,409,999 | A | 10/1983 | Pedziwiatr | |
| 4,469,526 | A | 9/1984 | Budinsky et al. | |
| 4,571,270 | A | 2/1986 | Sasaki | |
| 4,582,077 | A | 4/1986 | Gabriel et al. | |
| 4,600,444 | A | 7/1986 | Miner | |
| 4,722,295 | A | 2/1988 | Young | |
| 4,731,154 | A | 3/1988 | Hausman Hazlitt et al. | |
| 4,796,042 | A | 1/1989 | Mappin et al. | |
| 4,893,320 | A | 1/1990 | Yanagi et al. | |
| 4,941,971 | A | 7/1990 | Albright | |
| 4,995,409 | A | 2/1991 | Watts | |
| 4,996,160 | A | 2/1991 | Hausman Hazlitt et al. | |
| 5,154,199 | A | 10/1992 | Thompson et al. | |
| 5,172,572 | A | 12/1992 | Ono | |
| 5,174,315 | A | 12/1992 | Hellstern et al. | |
| 5,188,135 | A | 2/1993 | Neumann et al. | |
| 5,201,958 | A | 4/1993 | Breunsbach et al. | |
| 5,265,446 | A | 11/1993 | Kuroda et al. | |
| 5,272,892 | A | 12/1993 | Janutka et al. | |
| 5,276,998 | A * | 1/1994 | Joen et al. | 451/35 |
| 5,284,523 | A | 2/1994 | Badami et al. | |
| 5,291,626 | A | 3/1994 | Molnar et al. | |
| 5,330,580 | A | 7/1994 | Whipple, III et al. | |
| 5,339,844 | A | 8/1994 | Stanford, Jr. et al. | |
| 5,346,629 | A | 9/1994 | Wuller | |
| 5,357,648 | A | 10/1994 | Noestheden | |
| 5,368,053 | A | 11/1994 | Wilson | |
| 5,396,178 | A | 3/1995 | Rybarski | |
| 5,411,042 | A | 5/1995 | Suzuki et al. | |
| 5,421,883 | A | 6/1995 | Bowden | |
| 5,444,531 | A | 8/1995 | Foreman et al. | |
| 5,470,394 | A | 11/1995 | Michel et al. | |
| 5,545,259 | A | 8/1996 | Suzuki et al. | |
| 5,555,583 | A | 9/1996 | Berkcan | |
| 5,560,060 | A | 10/1996 | Dausch et al. | |
| 5,586,567 | A | 12/1996 | Smith et al. | |
| 5,647,386 | A | 7/1997 | Kaiser | |
| 5,661,872 | A | 9/1997 | Meyer et al. | |
| 5,706,840 | A | 1/1998 | Schneider et al. | |
| 5,730,163 | A | 3/1998 | Meyer et al. | |
| 5,746,233 | A | 5/1998 | Kuroda et al. | |
| 5,800,628 | A | 9/1998 | Erickson et al. | |
| 5,923,432 | A | 7/1999 | Kral | |
| 5,931,173 | A | 8/1999 | Schiele | |
| 5,954,070 | A | 9/1999 | Abad et al. | |
| 5,954,071 | A | 9/1999 | Magliocca | |
| 5,960,804 | A | 10/1999 | Cooper et al. | |
| 6,007,640 | A | 12/1999 | Neff et al. | |
| 6,073,540 | A | 6/2000 | Garrett | |
| 6,073,640 | A | 6/2000 | McTaggart | |
| 6,115,541 | A | 9/2000 | Rhodes | |
| 6,119,365 | A | 9/2000 | Wuller et al. | |
| 6,126,099 | A | 10/2000 | Fachinger et al. | |
| 6,129,099 | A | 10/2000 | Foster et al. | |
| 6,244,279 | B1 * | 6/2001 | Bowden | 134/71 |
| 6,334,266 | B1 | 1/2002 | Moritz et al. | |
| 2001/0015096 | A1 | 8/2001 | Hoffman | |

FOREIGN PATENT DOCUMENTS

| | | |
|---|---|---|
| CA | 667441 | 7/1963 |
| CA | 669262 | 8/1963 |
| CA | 699331 | 12/1964 |
| CA | 699537 | 12/1964 |
| EP | 0 227 275 | 7/1987 |
| GB | 817851 | 8/1959 |
| GB | 817860 | 8/1959 |
| JP | 55-103608 | 8/1980 |
| JP | 59-97512 | 8/1981 |
| JP | 60-16275 | 1/1985 |
| JP | 60-21798 | 2/1985 |
| JP | 60-163689 | 8/1985 |
| JP | 61-25599 | 2/1986 |
| JP | 62-259442 | 11/1987 |
| JP | 2-107296 | 4/1990 |

* cited by examiner

PARTS WASHER SYSTEM

BACKGROUND OF THE INVENTION

The present invention relates generally to industrial machinery and more specifically to a parts washer system.

Industrial parts washers are commonly used to remove debris, such as machining burrs, grease and dirt, from metallic parts such as engine blocks and crankshafts. Two such conventional devices are disclosed in Canadian Patent No. 669,262 entitled "Washing Apparatus" which issued to Umbricht on Aug. 27, 1963, and United Kingdom Patent No. 817,851 entitled "Improvements in or Relating to Washing Apparatus" which was published on Aug. 6, 1959. Another known industrial parts washer is disclosed in U.S. Pat. No. 3,059,861 entitled "Adjustable Spray Nozzle Assembly" which issued to Umbricht et al. on Oct. 23, 1962, and is incorporated by reference herein. Many traditional industrial parts washers typically flow a cleaning liquid onto the part for a predetermined period of time regardless of how clean the part actually is and regardless of part-to-part variability. Thus, the historical worst case scenario is commonly used to define the future predetermined period for cleaning which often leads to a sometimes slower than necessary process even for parts which are relatively clean after the prior machining operations.

Other cleaning devices are known in different industries as disclosed, for example, in the following U.S. patent application and patents: US 2001/0015096 A1 entitled "Monitoring of Particulate Matter in Water Supply" which was published on Aug. 23, 2001; U.S. Pat. No. 5,647,386 entitled "Automatic Precision Cleaning Apparatus with Continuous On-Line Monitoring and Feedback" which issued to Kaiser on Jul. 15, 1997; and U.S. Pat. No. 5,560,060 entitled "System and Method for Adjusting the Operating Cycle of a Cleaning Appliance" which issued to Dausch et al. on Oct. 1, 1996; all of which are incorporated by reference herein. These conventional devices, however, appear to have little application in the industrial parts industry for cleaning machining burrs and manufacturing plant dirt, especially for large parts having long internal passageways.

SUMMARY OF THE INVENTION

In accordance with the present invention, a parts washer system includes a cleaning fluid and a sensor. In another aspect of the present invention, an industrial parts washer includes a housing, a conveyor, a cleaning solution and a particle detector. Still another aspect of the present invention employs a controller which is operable to stop the cleaning of an industrial part if a debris-to-cleaner ratio reaches a target value. A method of operating a parts washer is also provided.

The present invention is advantageous over conventional machines in that the present parts washer easily determines the cleanliness of an industrial part in a non-obtrusive and real time manner. Thus, the cleaning cycle can vary from part-to-part as needed. Accordingly, cleaning quality is improved for parts having excessive burrs and debris while cycle time is quickened for relatively clean parts. The present invention thereby improves overall processing speed and quality while reducing traditional energy costs to run the process based on average or worse case times. Additional advantages and features of the present invention will become apparent from the following description and appended claims, taken in conjunction with the accompanying drawings.

DETAILED DESCRIPTION OF THE PREFERRED EMBODIMENTS

Figure 1:
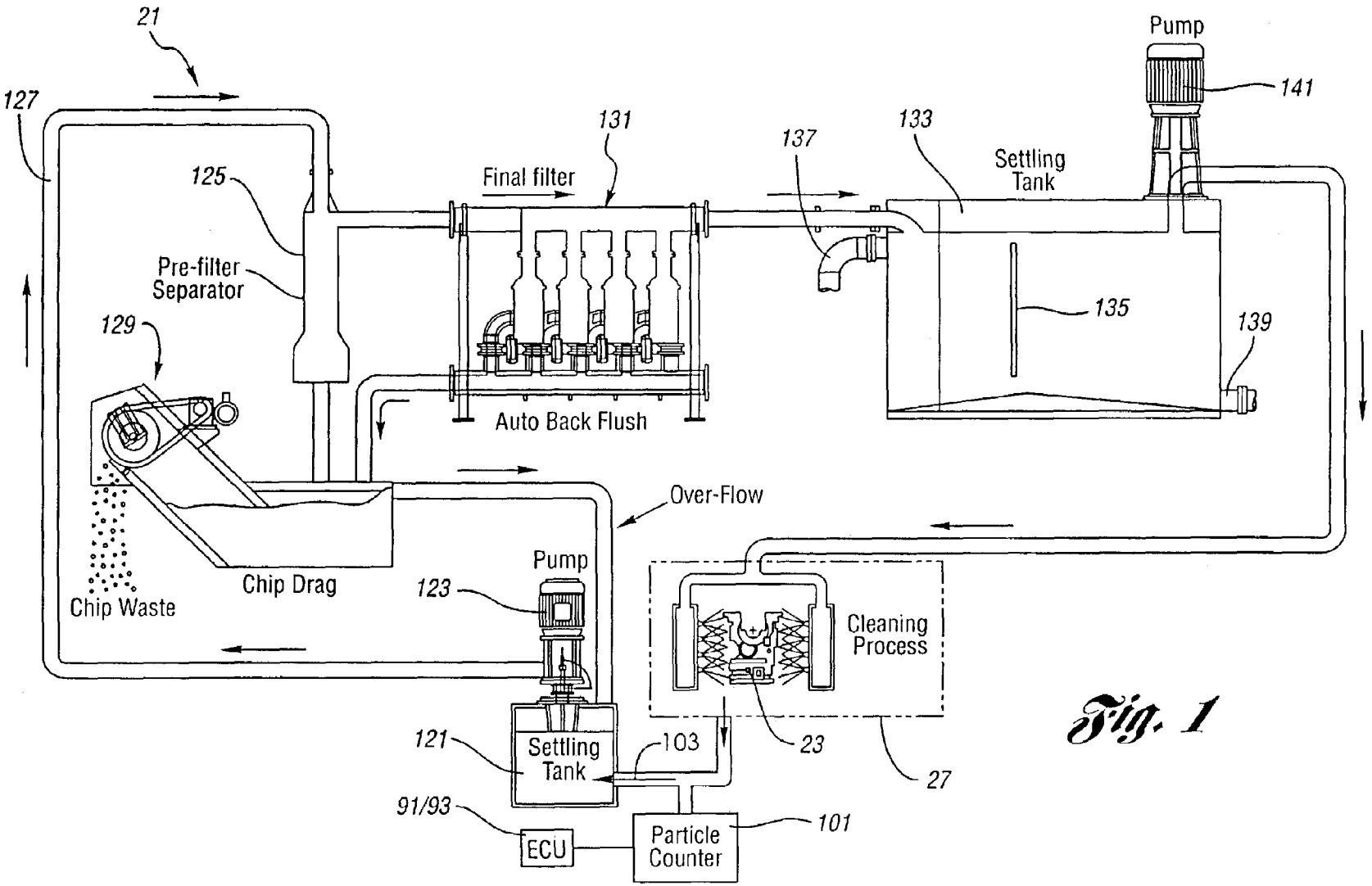
FIG. 1 is a diagrammatic view showing the preferred embodiment of a parts washer system of the present invention.
Figure 2:
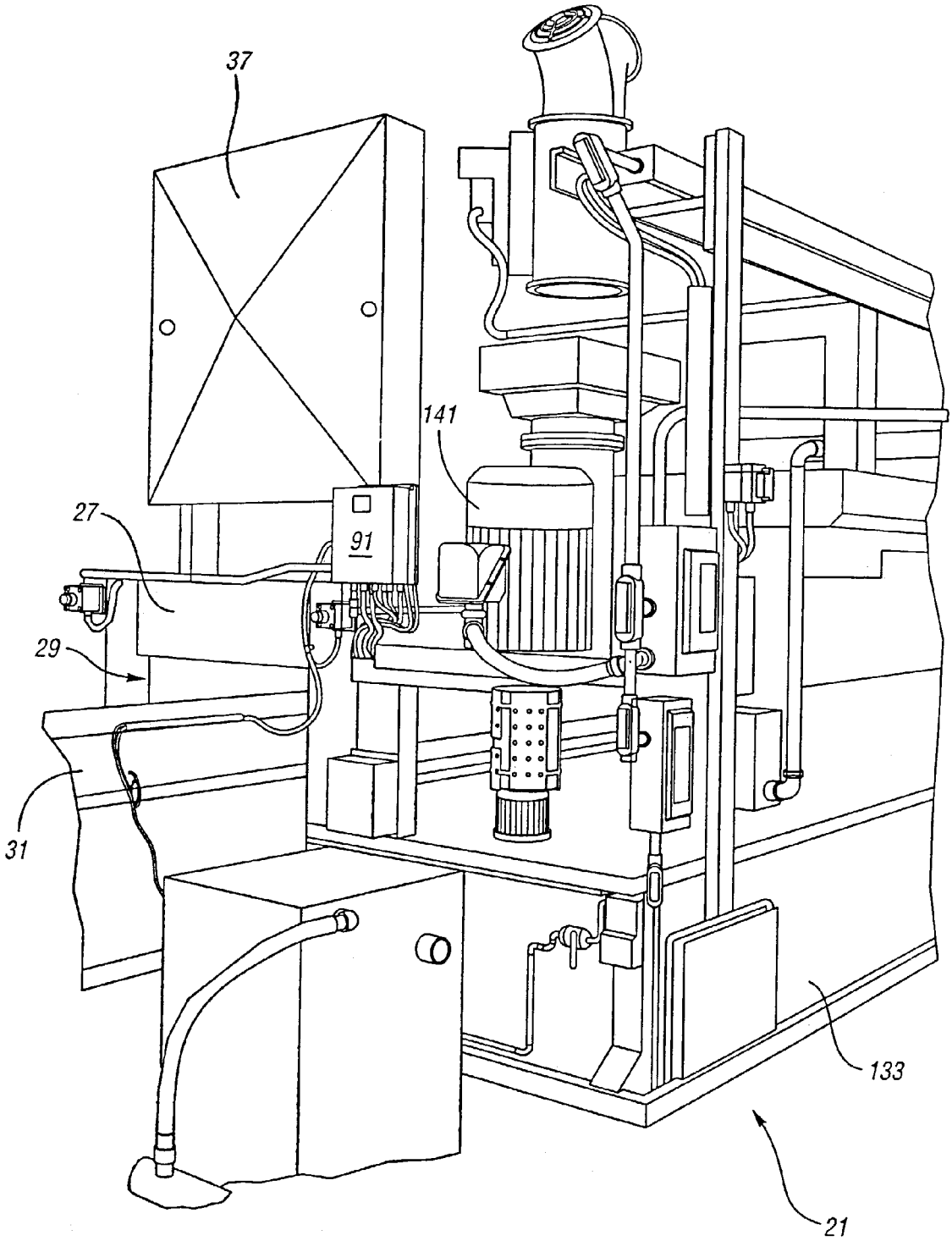
FIG. 2 is a perspective view showing a portion of the preferred embodiment parts washer system.

Referring to FIGS. 1, 2, 4 and 6, the preferred embodiment of a parts washer system 21 is used in an industrial manufacturing plant to clean machining burrs, grease, dirt and other manufacturing debris from industrial parts or workpieces such as automotive vehicle powertrain components, including an engine block 23 (see FIG. 1), a metallic crankshaft 25 (see FIGS. 4 and 6), or the like. Parts washer system 21 operates as a cleaning station after a machining station (not shown) where the part has elongated internal pasageways or other features added by a milling machine, lathe, or similar automatic tools. Parts washer system 21 includes a sheet metal housing 27 affixed to the factory floor. Housing 27 essentially encloses the parts cleaning station yet has an entryway 29 for allowing access entry and exit by a horizontally moving shuttle 31 or other type of automatically operating conveyor. Shuttle 31 has a pair of parallel rails 33 upon which are mounted spaced apart perches 35 for carrying a set of parts 25 into the housing. A vertically movable access door (shown in a raised position in FIG. 2) is lowered after shuttle 31 moves inside housing 27.

FIGS. 4–8 show the internal components of parts washer system 21 for use with the crankshaft-type parts 25. A programmable logic controller ("PLC") first causes shuttle 31 to be automatically moved inside housing 27 to align each part 25 with a corresponding seal and flush unit 51. Seal and flush unit 51 includes a set of offset and parallel upper seals 53 having a generally semi-circular contacting surface shape made from a polymeric material such as polypropylene, polyurethane or nylon. Each upper seal 53 is affixed to a seal support 55 which has hollow bores to allow for internal fluid flow from an attached upper manifold 57. A flexible in-flow pipe or hose 59 is coupled to upper manifold 57 whereby clean washing fluid sequentially flows through in-flow pipe 59, through upper manifold 57, through upper seal supports 55, around a concave cross-sectional channel within the semi-circular contacting surface of each upper seal 53, which then contacts and seals against an upper matching surface of part 25. Each seal and flush unit 51 further includes a set of lower seals 61 and hollow seal supports 63 which are all in communication with and coupled to an outflow manifold 65. Lower seals 61 serve to collect the washing fluid that has been transmitted through the outside surface and internal passages in part 25 and then transfer the now dirty washing fluid to the outflow manifold 65.

Figure 3:
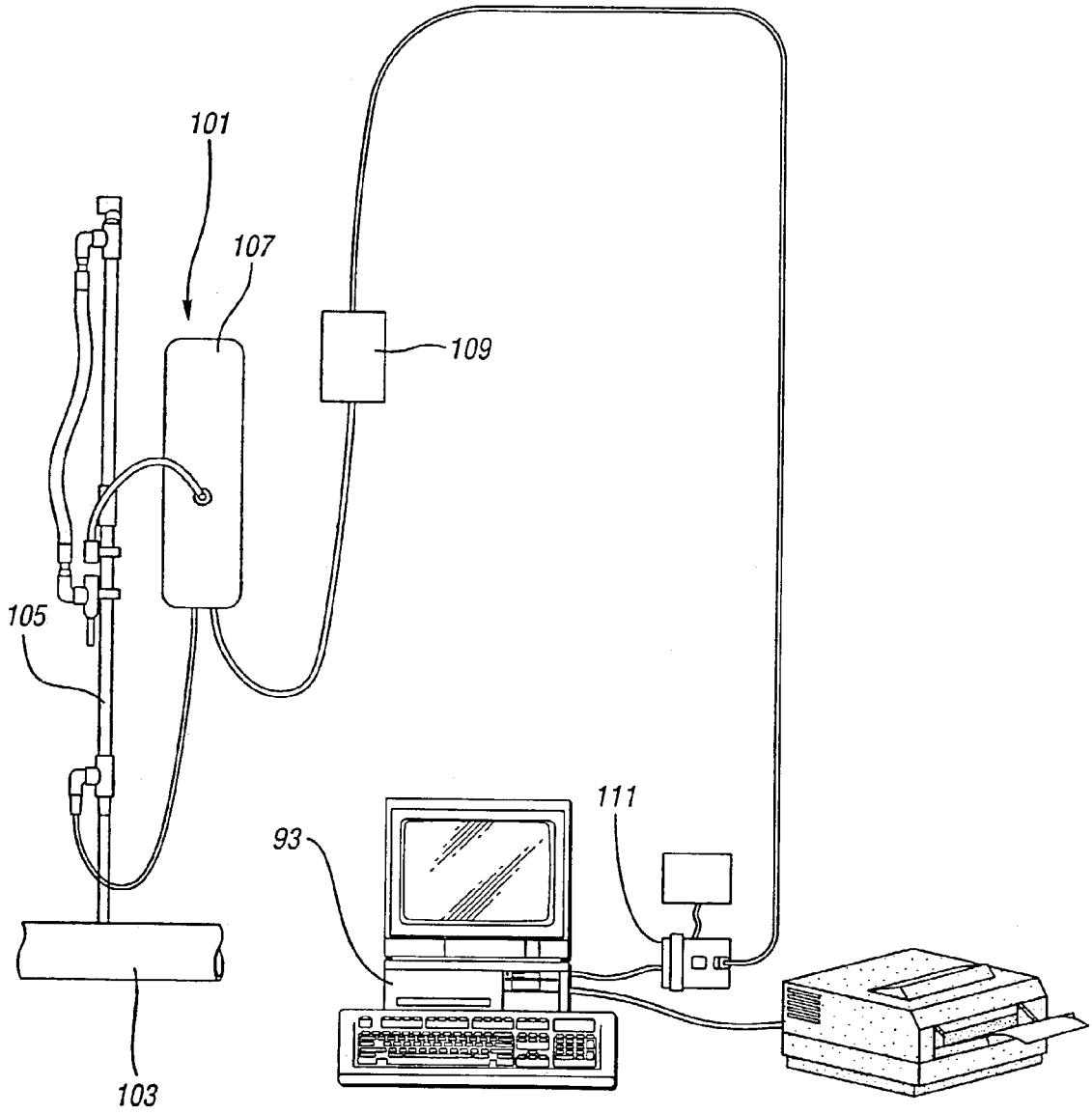
FIG. 3 is a side elevational view showing a portion of the preferred embodiment parts washer system.
Figure 4:
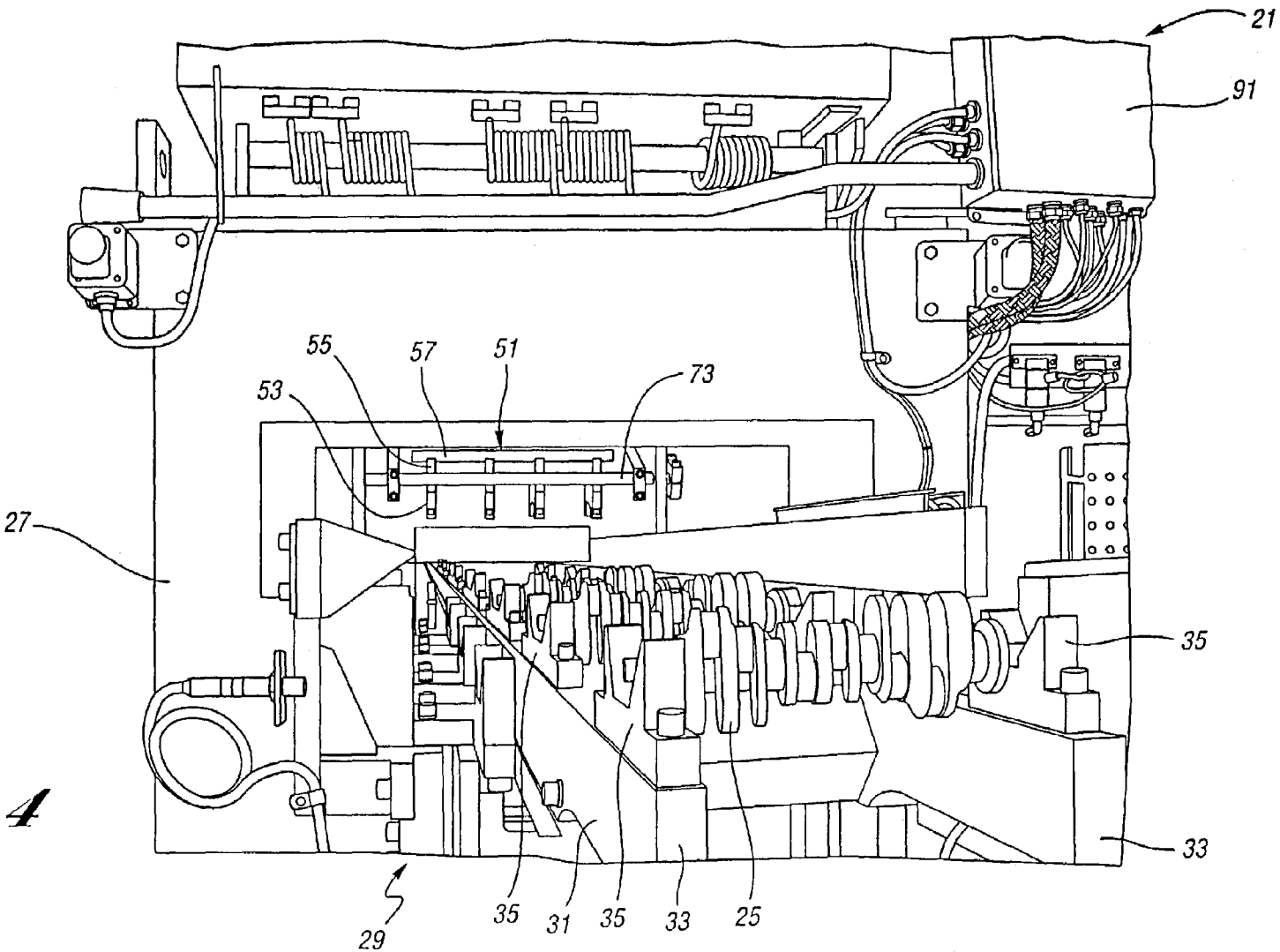
FIG. 4 is a perspective view, adjacent a part entry, showing a portion of the preferred embodiment parts washer system.
Figure 5:
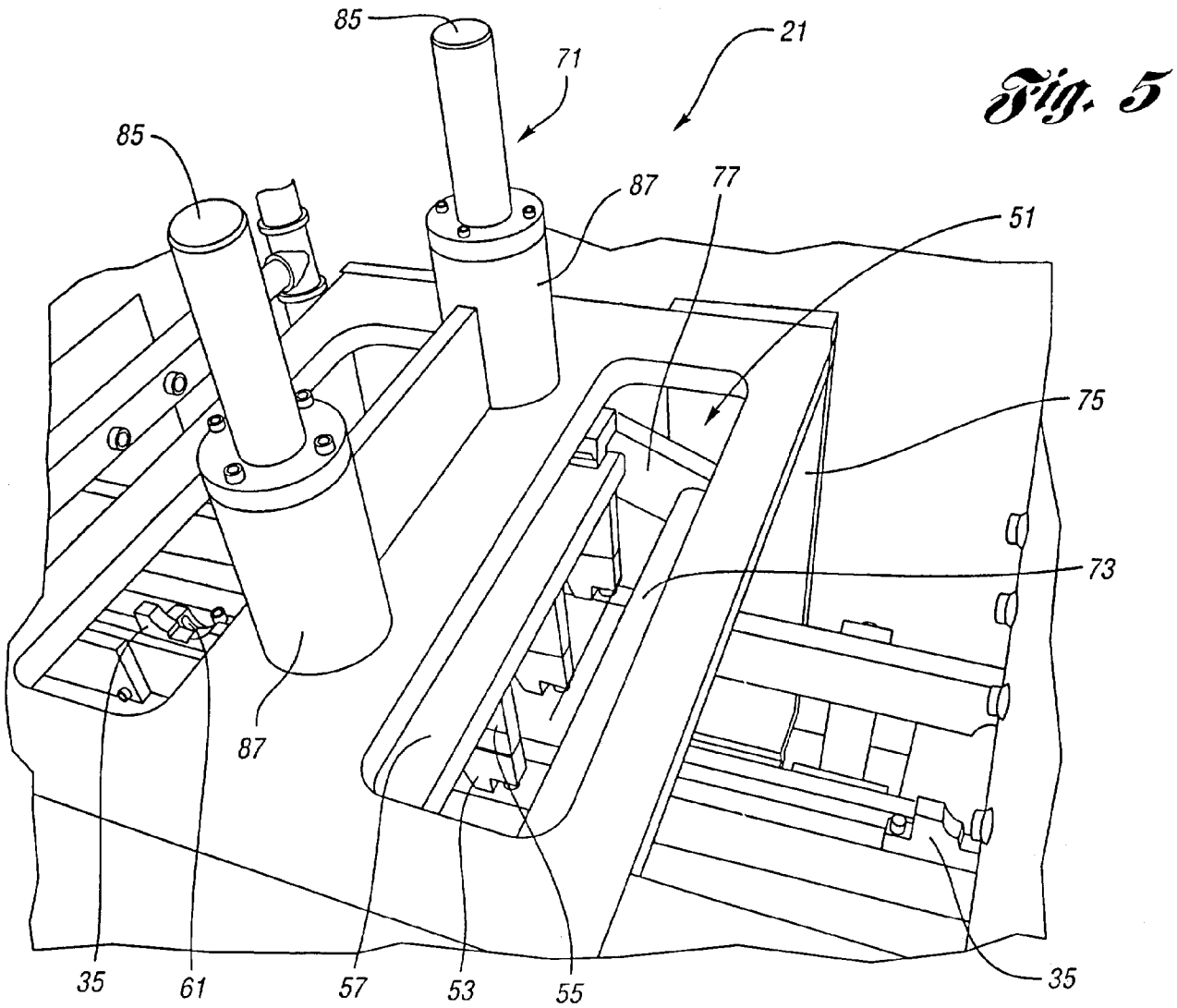
FIG. 5 is a perspective view, adjacent a top corner, showing a seal and flush mechanism employed in the preferred embodiment parts washer system.
Figure 6:
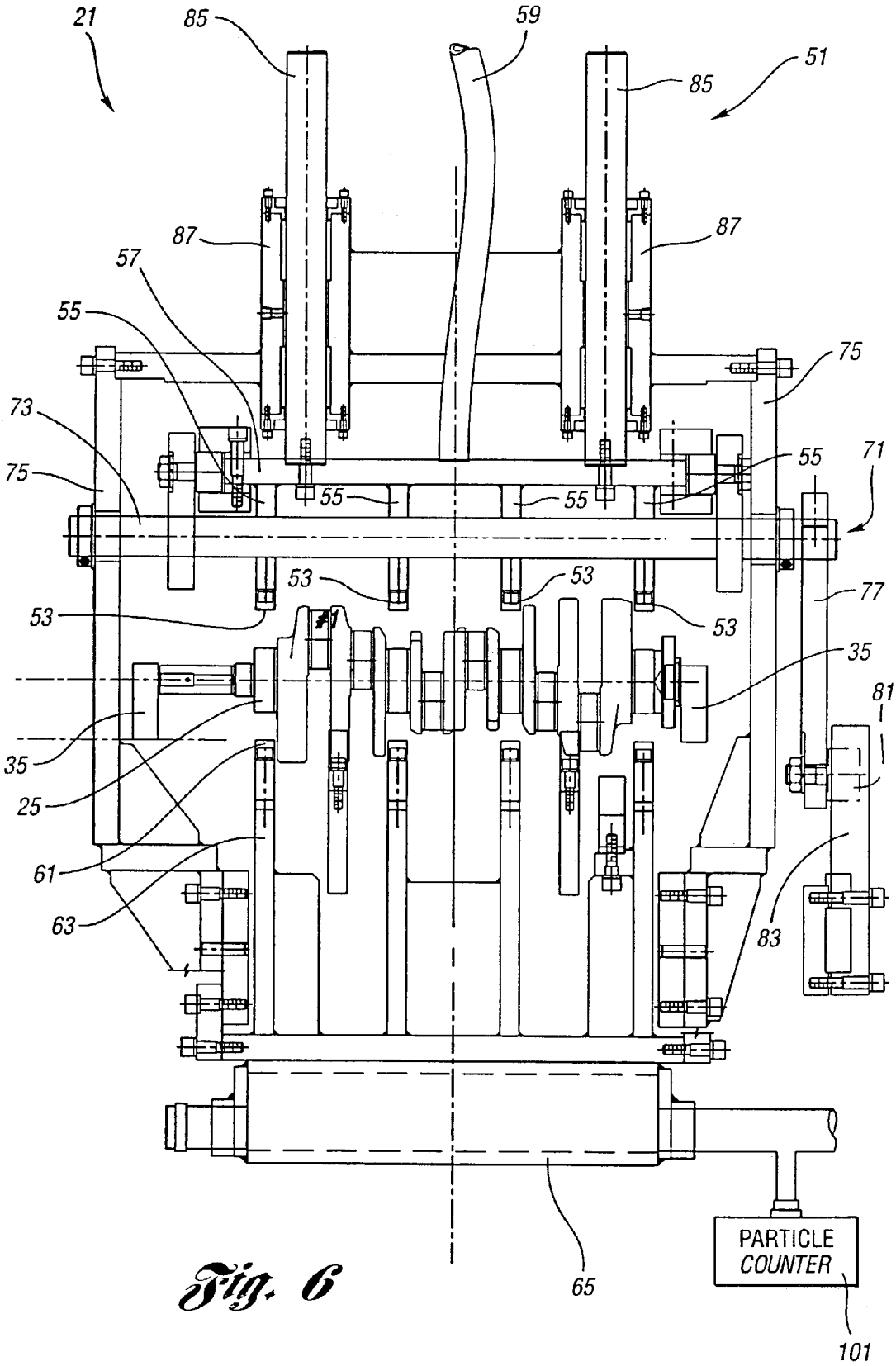
FIG. 6 is a side diagrammatic view showing the seal and flush mechanism employed in the preferred embodiment parts washer system, with the mechanism in a raised position.
Figure 7:
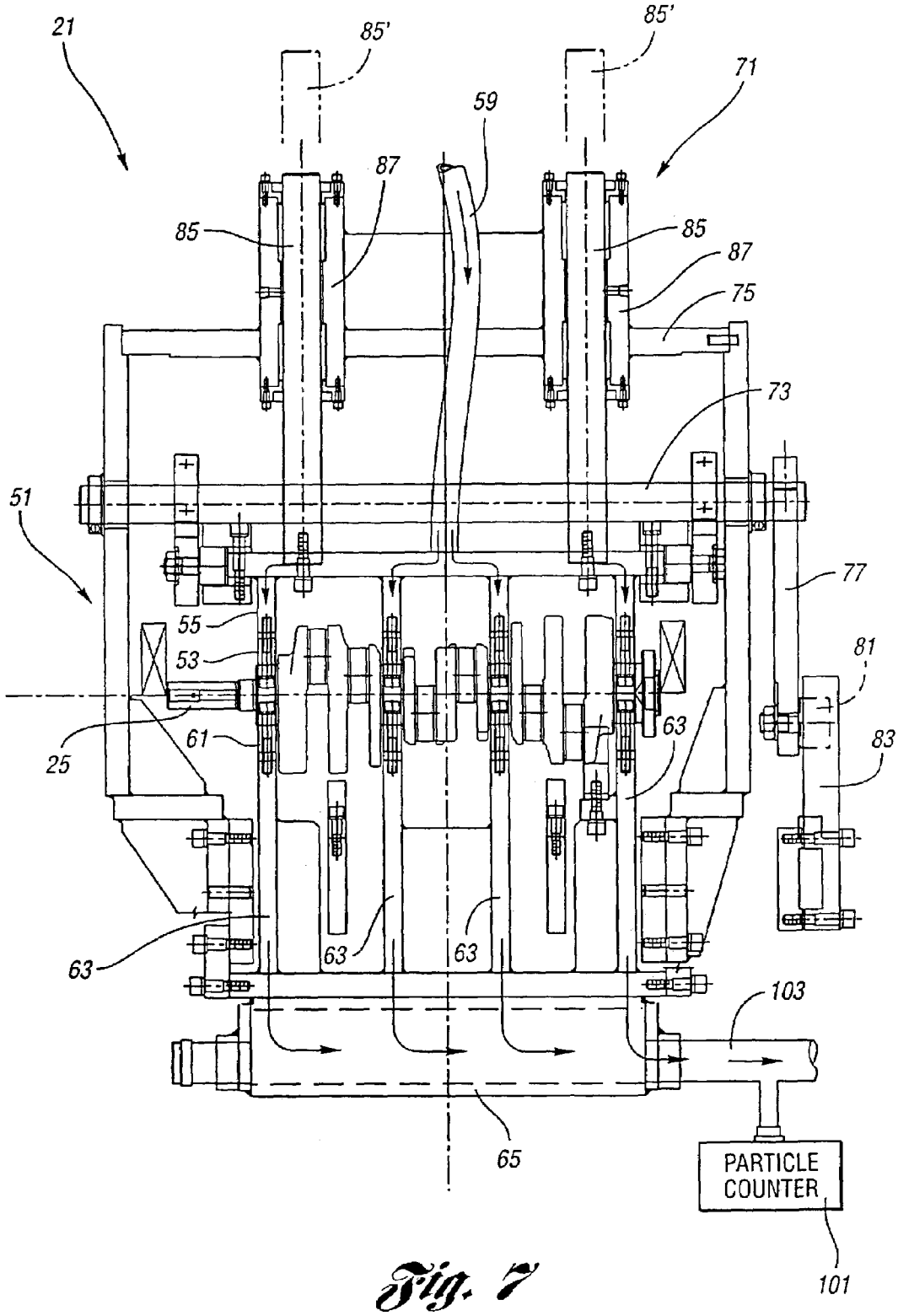
FIG. 7 is a side diagrammatic view, like that of FIG. 6, showing the seal and flush mechanism employed in the preferred embodiment parts washer system, with the mechanism in a closed position.
Figure 8:
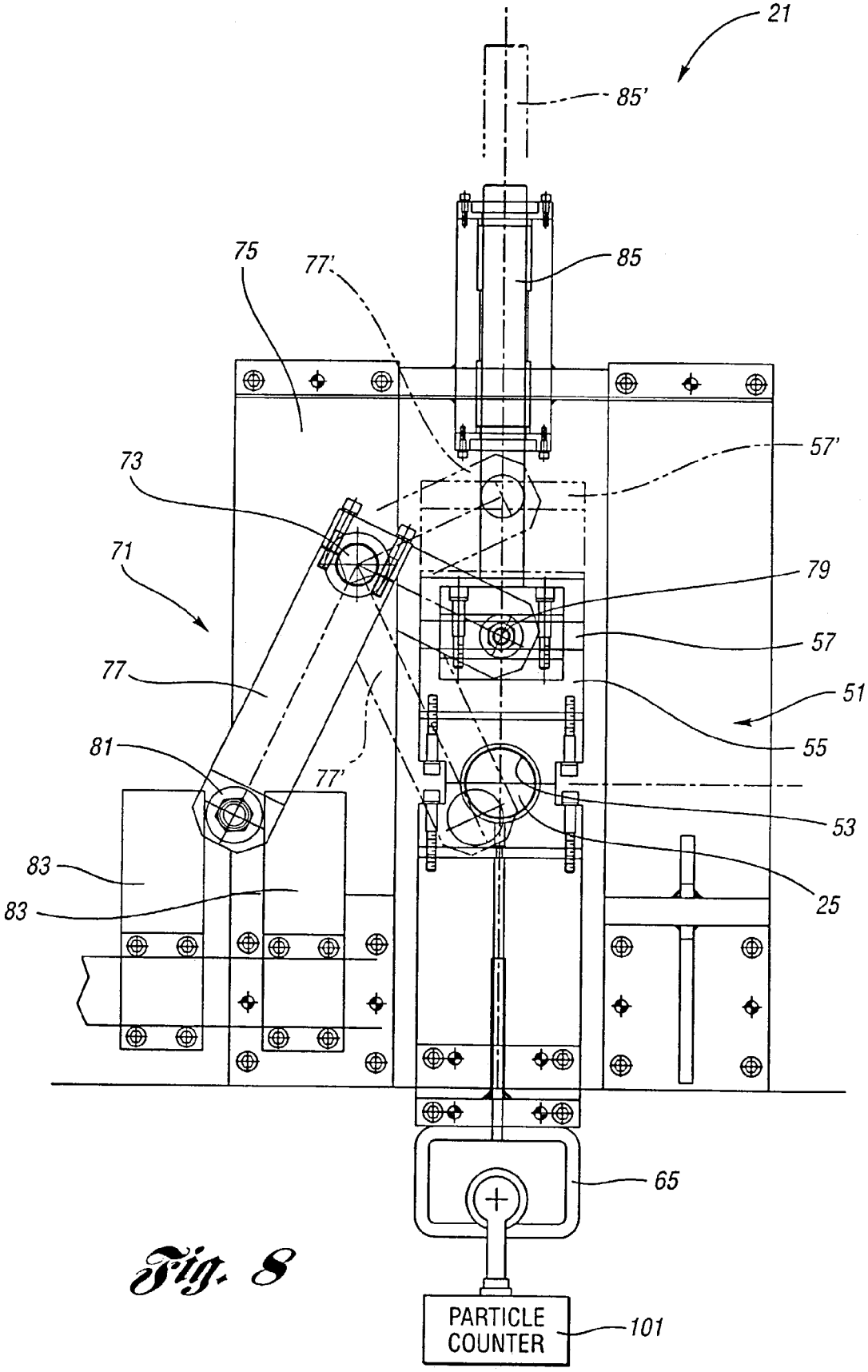
FIG. 8 is an end diagrammatic view showing the seal and flush mechanism employed in the preferred embodiment parts washer system, with the mechanism in a raised position.

A movement mechanism 71 employs a pivot bar 73 which is rotatably fixed to a frame 75, stationary relative to housing 27. An L-shaped arm 77 is rotatably cantilevered about pivot bar 73 at its elbow, and has a first end pivotally coupled to upper manifold 57 at a first pivot 79. A roller 81 is coupled to an outside of an opposite end of arm 77 and is located between two upstanding structures 83 which are fastened to one of the rails 33 of shuttle 31. Furthermore, guide pins 85 vertically slide within upstanding collars 87 affixed to a top wall of frame 75 in order to assist in accurate movement of the upper segment of seal and flush assembly 51. Accordingly, normal movement of shuttle 31 and parts 25 from the initial loading position external to housing 27, to the washing position aligned with seal and flush assembly 51 internal to housing 27 (parts 25 moving from right to left as shown in FIG. 8), causes structures 83 to rotate arm 77 about pivot bar 73 thereby lowering upper manifold 57 and the attached upper seals 53 to contact against part 25. A proximity or other electrical switch senses that seal and flush assembly 51 has engaged parts 25, whether directly or indirectly, and an appropriate signal is sent to the attached programmable logic controller 91 or other electrical control unit, such as a micro processor based personal computer controller 93 (see FIG. 3); the controller subsequently causes the cleaning process to begin by operating a set of motors and pumps to begin the flow of cleaning fluid.

Reference should now be made to FIGS. 1, 3, 7 and 8. A particle counter-type turbidity sensor 101 is coupled to an outflow pipe 103 which is, in turn, coupled to a downstream end of outflow manifold 65. One satisfactory particle counter sensor 101 is a model 215W Liquidborne Laser particle counter which can be obtained from Met One of Grants Pass, Oreg. Such a particle counter sensor includes a water weir flow controller 105, a sensor 107, an electrical module 109 for power and communications, an adapter 111, personal computer 93 for real-time sensing, data processing, storing and outputting particle counting data from the out flowing cleaning fluid and for comparing the actual sensed readings to either predetermined targets (representing a satisfactory cleaning fluid value or range) or previously sensed values thereby optimizing and controlling each washing cycle based on these real-time sensed values relative to the target values. In other words, the parts washer system performs by: (a) removing debris from a first machined workpiece by washing the first workpiece with a cleaning liquid; (b) sensing the cleanliness of the solution after workpiece washing; (c) communicating a signal of the sensed value to an electronic control unit; (d) automatically comparing the signal to a predetermined or target value; (e) determining the amount of debris in the liquid; (f) removing at least some of the debris from the liquid; (g) automatically varying a fluid flow characteristic of the liquid if the sensed value is substantially the same or different as compared to the predetermined value, wherein the characteristic includes, but is not limited to, re-using the liquid to subsequently remove debris from the same workpiece if the values are different, or automatically terminating the fluid flow and cleaning of the first workpiece if the sensed value of the liquid reaches the target debris-free value; (h) automatically removing the workpiece from the washer if the sensed value is substantially the same as the predetermined value; and (i) reusing the liquid to subsequently remove debris from additional workpieces. Furthermore, computer 93 stores, calculates and outputs historical statistical trends based on sensed cleaning fluid readings; this can include standard deviation and averaging calculations. Additionally, computer and particle counter sensor 101 can provide an output as to the filtering success for various desired time periods for the recycled cleaning fluid, in order to inform the operator as to when filter cleaning, cleaning fluid disposal or other maintenance may be desired in order to further optimize the process. The computer and particle counter sensor are further able to sense and calculate the cleanliness of the prior machining operations through sensed values and even if part aperture blockages have occurred as will be discussed in more detail with various of the alternate embodiments.

FIG. 1 shows the remainder of the parts washer system 21 fluid flow outside of the housing. A "dirty" settling tank 121 is connected to the downstream end of outflow pipe 103. A motor and pump 123 serve to pump cleaning fluid from tank 121 to a pre-filter separator 125 by way of another pipe 127. Pre-filter separator 125 employs an approximately 75 micron filtering system. Machining chips, debris and other settled out or filtered out particulate matter is then moved and discarded by way of a conventional chip drag and chip waste mechanism 129. A final filter assembly 131 is disposed downstream of pre-filter separator 125 to further filter out undesired particles and debris from the cleaning fluid by use of an approximately 50 micron filtering system. Final filter assembly 131 includes a media filter while pre-filter 125 employs a centrifugal filter. A "clean" settling tank 133 is located downstream of final filter assembly 131 and further allows for holding of the cleaning fluid for subsequent washing while allowing some additional particulate settling. Settling tank 133 includes a weir 135, an overflow pipe 137 and a cleaning drain 139. Another pump and motor 141 serve to flow the cleaning fluid from settling tank 133 to the part washing station within housing 27 when energized by the controller. It should be appreciated, however, that many other filtering and settling components can be used in place of or in addition to those disclosed herein. Notwithstanding, it is highly desirable to employ a closed loop and recyclable cleaning fluid system in order to reduce disposal costs and to save on cleaning fluid expense. The cleaning fluid is preferably a water borne, alkaline liquid solution containing a degreaser and a detergent. It is also envisioned that an electrolyte solution including disodium phosphate, sodium bicarbonate and water can be employed; such a solution is disclosed in U.S. Pat. No. 6,264,823 entitled "Non-Caustic Cleaning of Conductive and Non-Conductive Bodies" which issued to Hoffmann, Jr. et al. on Jul. 24, 2001, and is incorporated by reference herein.

Only a single particle counter sensor is needed, thereby saving equipment cost and reducing controller processing speed requirements, however, it is alternately envisioned that a second particle counter sensor located upstream of the part to be washed can be used in addition to the downstream particle counter sensor 101 in order to allow a more direct comparison calculation of real-time sensed fluid value measurements by the controller without possible variations caused by the closed loop system filters and tanks.

Figure 9:
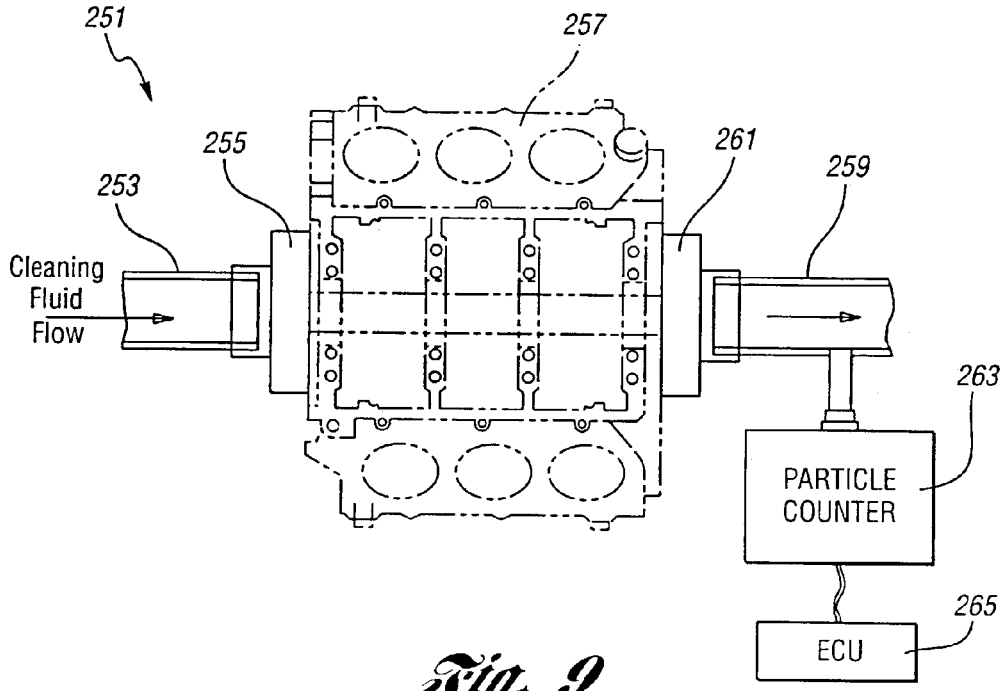
FIG. 9 is a diagrammatic top view showing a first alternate embodiment of the parts washer system of the present invention.

FIG. 9 illustrates a first alternate embodiment of a parts washer system 251 of the present invention. An in-flow pipe 253 and sealing unit 255 are automatically moved to contact and seal against a first side of an oil gallery, including a crankshaft bore, rocker arm paths, piston cylinder bores and the like, of an automotive vehicle engine block part or workpiece 257. At an opposite end of the oil gallery of engine block 257, an outflow pipe 259 and a corresponding sealing unit 261 are automatically moved to interface with part 257. This occurs within a housing of a parts washing station such as in the closed loop system of FIG. 1. A particle counter sensor 263 is coupled to outflow pipe 259 and an electrical control unit 265 is electrically connected to particle counter sensor 263. Thus, "clean" cleaning fluid automatically flows into the upstream side of part 257 and then exits as "dirty" cleaning fluid containing debris through outflow pipe 259. At this point, particle counter sensor 263 senses the concentration of debris within the cleaning fluid and sends a corresponding signal to controller 265 for processing of this information and comparing the real-time sensed values to the target cleaning fluid particulate concentration values in order to further control the cleaning cycle time.

Figure 10:
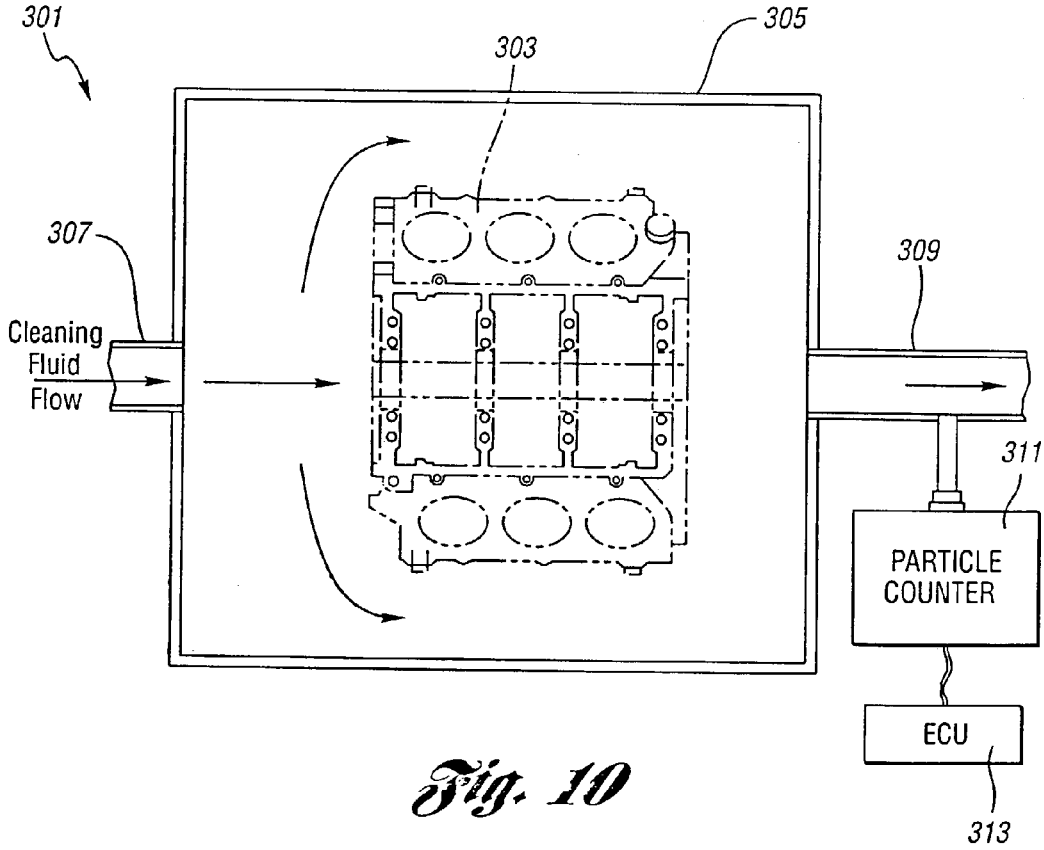
FIG. 10 is a diagrammatic top view showing a second alternate embodiment of the parts washer system of the present invention.

FIG. 10 illustrates a second alternate embodiment of a parts washing system 301 of the present invention wherein an engine block part or workpiece is fully immersed or submerged into a tank 305 essentially filled with cleaning fluid. The cleaning fluid automatically enters through an upstream inlet 307, flows through passageways in and completely around part 303, and then subsequently exits through an outlet pipe 309 coupled to a particle counter 311 and an electrical control unit 313.

Figure 11:
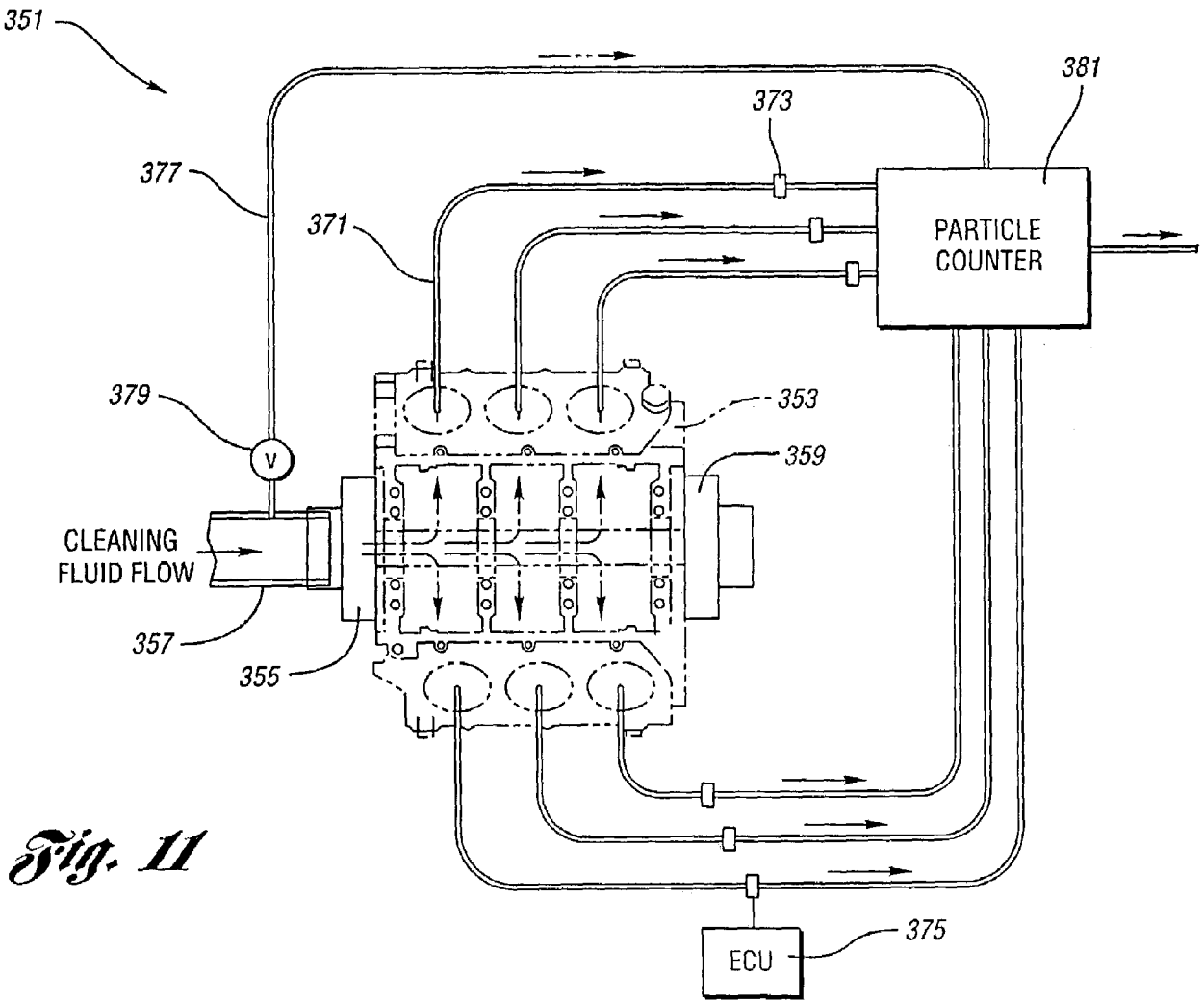
FIG. 11 is a diagrammatic top view showing a third alternate embodiment of the parts washer system of the present invention.

A third alternate embodiment parts washing system 351 of the present invention is shown in FIG. 11. An engine block part 353 or the like is placed within a housing of a cleaning station wherein a first end is automatically contacted by a sealing unit 355 connected to an in-flow pipe 357. An opposite end of part 353 has a sealing plug unit 359 automatically attached. A set of outlet lines or tubes 371 is automatically moved to contact and seal against corresponding external openings such as piston cylinder bores, of part 353. A cantilevered movement mechanism such as that disclosed with the preferred embodiment can be employed to automatically move lines 371 relative to part 353. A flow sensor 373 is located within each line 371 to sense the volume, speed or pressure of fluid flowing through the corresponding line. An electrical control unit 375, connected to the flow sensors 373 compares the real-time flow sensor readings against either predetermined desired target values or against a baseline reading from a flow sensor mounted within a diversion line 377 located upstream of part 353. A diversion valve 379 allows for a diverted initial fluid flow through diversion line 377 at the beginning of each part cleaning cycle which may thereafter be shut off. The controller comparisons and calculations based on the flow sensor signals allow for an automatic and computerized determination of whether a blockage, such as by incomplete machining, is present in any internal passageway or aperture within part 353. This provides real-time and automated quality control checking on every manufactured part even in hidden internal and elongated passageways. A particle counter sensor 381 is also positioned downstream and connected to outlet lines 371 and 377. Particle counter sensor 381 is electrically connected to controller 375 to determine the concentration of debris or other undesired particles within the cleaning fluid to thereby automatically monitor and control the parts washing cycle for each part or batch of parts. It should be appreciated that the flow sensor inspection/monitoring, calculations and system control can be used independently of the particle counter sensor functions.

Various embodiments of the present invention parts washer system have been disclosed, however, it should be appreciated that other modifications may be made. For example, while a liquid cleaning fluid has been disclosed, air or other gaseous cleaning fluids can also be used. It should also be appreciated that other nonindustrial and nonautomotive parts can be employed with the apparatus of the present invention although some of the advantages of the present invention may not be achieved. Furthermore, movement mechanisms such as those using sprockets and chains, jackscrews, cams or gears can be used instead of or in addition to the cantilevered mechanism disclosed. Moreover, magnetic, optical or electrical sensors can be substituted in place of the particle counter sensor disclosed, although the performance may vary. While various materials have been disclosed, it should be appreciated that other materials may be employed. It is intended by the following claims to cover these and any other departures from the disclosed embodiments which fall within the true spirit of this invention.

The invention claimed is:

1. An industrial parts washer system operable to wash an industrial part, the parts washer system comprising:

washing fluid;

a flushing assembly operable to apply the washing fluid to the industrial part;

a single turbidity sensor coupled to the assembly operable to sense a condition of the washing fluid after the fluid washes the industrial pad; and a control unit connected to the sensor, the control unit operably comparing the sensed condition of the washing fluid to a value in order to determine if the industrial part should be washed further, the control unit operably stopping the assembly from flowing the washing fluid to the part, moving the washed part out of the assembly, and moving a subsequent dirty part into the assembly, if the sensed condition of the washing fluid substantially equals the value.

2. The parts washer system of claim 1 wherein the assembly includes:

a seal and flushing device being automatically advanced toward the part; and an inflow system operable to transport the washing fluid to the flushing device;

the seal operably contacting against the part such that the flushing device operably causes the washing fluid to flow to the part.

3. The parts washer system of claim 2 wherein the assembly further includes an outflow system operable to transport the washing fluid away from the part after the part is washed, and the sensor being coupled downstream of at least a section of the outflow system.

4. The parts washer system of claim 3 wherein the outflow system includes a manifold having multiple inlets, and the sensor is located downstream of the manifold.

5. The parts washer system of claim 1 further comprising a conveyor operably carrying multiples of the part to the assembly in an automatic manner.

6. The parts washer system of claim 5 further comprising:

a filter located downstream of the assembly operably filtering undesired particles from the washing fluid;

a settling tank located downstream of the filter operably removing further undesired particles from the washing fluid; and a pump operably flowing the fluid from the settling tank to the assembly.

7. The parts washer system of claim 1 wherein the cleaning fluid is a liquid which includes an industrial degreasing detergent.

8. The parts washer system of claim 1 wherein the part is an automotive vehicle powertrain component and the parts washer system cleans the automotive vehicle powertrain component.

9. The parts washer system of claim 8 wherein the part includes an elongated internal passage and the parts washer system provides fluid to flow through the elongated internal passage.

10. The parts washer system of claim 1 wherein the sensor is a particle counter.

11. The parts washer system of claim 1 wherein the assembly flows the fluid to the part without submersing the part in the fluid.

12. The parts washer system of claim 1 further comprising a substantially closed loop system flowing the cleaning fluid to the assembly.

13. The parts washer system of claim 1 wherein the control unit is an electronic control unit.

14. The parts washer system of claim 1 wherein the flushing assembly includes a submersion tank.

15. An industrial parts washer system comprising:

an automotive vehicle, powertrain part;

a flushing assembly operable to apply the washing fluid to the part, the flushing assembly comprising a seal and a flushing device, the seal operably contacting against the part such that the flushing device operably causes the washing fluid to flow to the part;

an inflow system operable to transport the washing fluid to the flushing device;

a turbidity sensor operable to sense a condition of the washing fluid after the fluid washes the part; and a controller connected to the sensor, the controller automatically evaluating the sensed condition of the washing fluid and determining if the part should be washed further, and the controller outputting historical statistical trends.

16. The parts washer system of claim 15 further comprising an outflow system operable to transport the washing fluid away from the part after the part is washed, and the sensor being coupled downstream of at least a section of the outflow system.

17. The parts washer system of claim 15 further comprising a conveyor automatically carrying multiples of the part to be cleaned by the washing fluid.

18. The parts washer system of claim 15 wherein the flushing assembly includes a submersion tank.

19. The parts washer system of claim 15 further comprising a shuttle operably moveable into and out of a housing, the housing containing the flushing assembly.

20. The parts washer system of claim 15 wherein the part is an engine block.

21. The parts washer system of claim 15 wherein the part is a crankshaft.

22. The parts washer system of claim 15 wherein the seal has a substantially semi-circular part-contacting surface shape.

23. The parts washer system of claim 15 further comprising a cantilevered arm operably pivoting to move at least a portion of the flushing assembly.

24. An industrial parts washer system comprising:

an automotive vehicle part;

washing liquid, a flushing assembly operable to apply the washing liquid to the part;

a shuttle automatically moving the part adjacent to the flushing assembly;

a sensor operable to sense a turbidity condition of the washing liquid; and an electrical controller connected to the sensor, the controller automatically evaluating the sensed condition of the washing liquid and determining if the part should be washed further;

the controller automatically stopping the flow of washing liquid to the part based at least in-part on the sensed condition of the washing liquid, and thereafter the controller being operable to cause the shuttle to move the part away from the flushing assembly and move a new dirty part adjacent to the flushing assembly to begin a new washing cycle.

25. The parts washer system of claim 24 wherein the assembly further includes an outflow system operable to transport the washing liquid away from the part after the part is washed, and the sensor being coupled downstream of at least a section of the outflow system.

26. The parts washer system of claim 25 wherein the outflow system includes a manifold having multiple inlets, and the sensor is located downstream of the manifold.

27. The parts washer system of claim 24 further comprising a seal having a substantially semi-circular part-contacting surface shape, the seal coupling the flushing assembly to the part.

28. The parts washer system of claim 24 wherein the part includes internal bores, the flushing assembly causing the washing liquid to flow into the bores, the controller determining if one of the bores is undesirably blocked.

29. The parts washer system of claim 24 wherein the flushing assembly includes a submersion tank.

30. The parts washer system of claim 24 wherein the part is an engine block.

31. The parts washer system of claim 24 wherein the part is a crankshaft.

32. The parts washer system of claim 24 further comprising a cantilevered arm operably pivoting to move at least a portion of the flushing assembly.

33. The parts washer system of claim 24 wherein the assembly includes:

a seal and a flushing device being automatically advanced toward the part; and an inflow system operable to transport the washing liquid to the flushing device;

the seal operably contacting against the part such that the flushing device operably causes the washing liquid to flow to the part; and the sensor being a turbidity sensor.

* * * * *

UNITED STATES PATENT AND TRADEMARK OFFICE

CERTIFICATE OF CORRECTION

PATENT NO. : 7,146,991 B2
APPLICATION NO. : 10/342977
DATED : December 12, 2006
INVENTOR(S) : David L. Stockert It is certified that error appears in the above-identified patent and that said Letters Patent is hereby corrected as shown below:

Column 1, line 2, insert:

--CROSS REFERENCE TO RELATED APPLICATION

This application claims priority to Provisional Application U.S. Serial No. 60/351,296, filed on January 23, 2002.--

Signed and Sealed this

Twenty-sixth Day of June, 2007

JON W. DUDAS
*Director of the United States Patent and Trademark Office*